US009651010B2

(12) United States Patent
Kim et al.

(10) Patent No.: US 9,651,010 B2
(45) Date of Patent: May 16, 2017

(54) FUEL INJECTOR FOR DIRECTLY INJECTING FUEL INTO A COMBUSTION CHAMBER OF AN ENGINE

(75) Inventors: Hyoung Jin Kim, Gyeonggi-do (KR); Kang Hun Lee, Gyeonggi-do (KR)

(73) Assignee: HYUNDAI KEFICO CORPORATION, Gyeonggi-Do (KR)

( * ) Notice: Subject to any disclaimer, the term of this patent is extended or adjusted under 35 U.S.C. 154(b) by 0 days.

(21) Appl. No.: 14/364,073

(22) PCT Filed: Sep. 6, 2012

(86) PCT No.: PCT/KR2012/007165

§ 371 (c)(1),
(2), (4) Date: Jul. 23, 2014

(87) PCT Pub. No.: WO2013/085140

PCT Pub. Date: Jun. 13, 2013

(65) Prior Publication Data

US 2014/0353409 A1 Dec. 4, 2014

(30) Foreign Application Priority Data

Dec. 9, 2011 (KR) ..... 10-2011-0132175

(51) Int. Cl.
*B05B 1/30* (2006.01)
*F02M 51/06* (2006.01)
(Continued)

(52) U.S. Cl.
CPC ..... *F02M 51/061* (2013.01); *F02M 51/066* (2013.01); *F02M 51/0685* (2013.01);
(Continued)

(58) Field of Classification Search
CPC ..... F02M 2200/50; F02M 2200/502; F02M 2200/505; F02M 2200/507; F02M 51/061;
(Continued)

(56) References Cited

U.S. PATENT DOCUMENTS 4,311,280 A * 1/1982 Knape ..... F02M 51/0685 239/585.2
5,033,716 A * 7/1991 Mesenich ..... 251/129.21
(Continued)

FOREIGN PATENT DOCUMENTS

EP 1602821 A1 12/2005
EP 1801409 A1 6/2007
(Continued)

*Primary Examiner* — Arthur O. Hall
*Assistant Examiner* — Adam J Rogers
(74) *Attorney, Agent, or Firm* — Gokalp Bayramoglu

(57) ABSTRACT

Provided is a direct spray fuel injector including a bundle of opening/closing valves, wherein the bundle of opening/closing valves includes: a valve needle that is disposed within a valve housing; an electromagnetic coil that is installed at a side opposite to the spray hole of the valve needle; an armature that is coaxially mounted on an outer circumferential surface of the valve needle to be slidable in an axial direction; and a pressurizing spring that is installed to pressurize the valve needle toward the spray hole and causes the valve needle to close the spray hole in normal times, and the bundle of opening closing valves is configured to pressurize the valve needle by the armature so that bounce generated when the valve needle in an open state approaches the spray hole so as to close the spray hole is able to be attenuated.

6 Claims, 7 Drawing Sheets

(51) Int. Cl.
*F02M 61/18* (2006.01)
*F02M 61/20* (2006.01)
*F02M 63/00* (2006.01)

(52) U.S. Cl.
CPC ..... *F02M 61/188* (2013.01); *F02M 61/20* (2013.01); *F02M 63/0061* (2013.01); *F02M 2200/304* (2013.01); *F02M 2200/306* (2013.01)

(58) Field of Classification Search
CPC ..... F02M 51/066; F02M 51/0685; F02M 61/188; F02M 61/20; F02M 63/0061; F02M 2200/304; F02M 2200/306
USPC ..... 239/583–585.5
See application file for complete search history.

(56) References Cited

U.S. PATENT DOCUMENTS 5,190,223 A * 3/1993 Mesenich ..... 239/585.5
6,131,829 A * 10/2000 Ricco ..... F02M 47/027 239/585.1
8,128,004 B2 * 3/2012 Koch ..... 239/5
2001/0022326 A1 * 9/2001 Keim ..... 239/585.5
2002/0020770 A1 * 2/2002 Miura et al. ..... 239/585.1
2003/0052203 A1 * 3/2003 Arndt et al. ..... 239/585.5
2003/0127531 A1 * 7/2003 Hohl ..... F02M 45/083 239/5
2006/0163390 A1 * 7/2006 Ruehle et al. ..... 239/585.1
2007/0205302 A1 * 9/2007 Ricco ..... F02M 47/027 239/96
2013/0221138 A1 * 8/2013 Rogler ..... F02M 51/06 239/585.5

FOREIGN PATENT DOCUMENTS

EP 1820958 A2 8/2007
EP 1801409 B1 8/2008
JP 2001003840 A 1/2001
JP 4135628 B2 8/2008
WO WO2011143552 A2 11/2011

* cited by examiner

FUEL INJECTOR FOR DIRECTLY INJECTING FUEL INTO A COMBUSTION CHAMBER OF AN ENGINE

CROSS-REFERENCE TO RELATED PATENT APPLICATION

This application claims the benefit of Korean Patent Application No. 10-2011-0132175, filed on Dec. 9, 2011 in the Korean Intellectual Property Office, the disclosure of which is incorporated herein in its entirety by reference.

BACKGROUND OF THE INVENTION

1. Field of the Invention

The present invention relates to a direct spray fuel injector, and more particularly, a direct spray fuel injector that is capable of efficiently suppressing and preventing bounce generated in a valve needle of a bundle of opening/closing valves when a spray hole of an injector for injecting a fuel under a high pressure is closed due to the bundle of opening/closing valves that opens and closes the spray hole of the injector.

2. Description of the Related Art

In general, most direct spray fuel injectors that directly inject a fuel into a combustion chamber of an engine recently operate and are controlled in an electronic manner. A representative example thereof may include an injector having an opening/closing valve structure marked by reference numeral 101 of FIG. 1.

The injector 101 includes a bundle of opening/closing valves 110 including a valve needle 105 that directly opens and closes a spray hole 113, an electromagnetic coil 107 that pulls the valve needle 105 when the spray hole 113 is opened, an armature 109 that pulls the valve needle 105 by gravity of the electromagnetic coil 107, and a pressurizing spring 111 that elastically pressurizes the valve needle 105 against the spray hole 113, as illustrated in FIG. 1.

Thus, the injector 101 according to the relate art closes the spray hole 113 due to a valve ball 125 when the valve needle 105 is pressurized toward the spray hole 113 together with a stop ring 115 pressurized by an elastic force of the pressurizing spring 111 in normal times when no injection operation is performed, as illustrated in FIGS. 1 and 2.

However, when the injector 101 operates so as to inject the fuel under the high pressure, first, the electromagnetic coil 107 of the bundle of opening/closing valves 110 is excited. Thus, the armature 109 is pulled by a magnetic force of the electromagnetic coil 107, compresses a buffer spring 120 against a stop sleeve 117, is lifted upwardly in the drawing and thus contacts the stop ring 115.

The armature 109 pulled by the electromagnetic coil 107 even after contacting the stop ring 115 compresses the pressurizing spring 111 through the stop ring 115 and is lifted, as illustrated in FIG. 3. Thus, the valve needle 105 is lifted together with the armature 109 and opens the spray hole 113 such that a high-pressure fuel filled in a housing 103 can be injected into the combustion chamber.

Then, when injection of the injector 101 is completed, in contrast, the electromagnetic coil 107 is demagnetized and thus gravity of the electromagnetic coil 107 that pulls the armature 109 disappears. Thus, the valve needle 105 intends to return to a normal state illustrated in FIG. 2 and to close the spray hole 113. However, the valve needle 105 is bounced due to an elastic repulsive force generated when the valve ball 125 and a valve seat around the spray hole 113 contact each other or a high spray pressure in the spray hole 113 and is again lifted upwardly in the drawing, as illustrated in FIG. 4. This is usually referred to as 'bouncing' of the valve needle 105. Further bounce of the valve needle 105 lifted in this way is suppressed and prevented when the stop sleeve 117 is pressurized downward by the armature 109 that descends downward in the drawing due to a restorative force of the buffer spring 120.

In this way, in the injector 101 according to the related art, the bundle of opening/closing valves 110 suppresses and prevents the bounce of the valve needle 105. Thus, a spring holder 118 that supports the buffer spring 120 needs to be additionally disposed at an opposite side to a side in which the stop sleeve 117 is formed, so as to elastically support the armature 109 due to the buffer spring 120. Also, the spring holder 118 needs to be fixed to a bottom surface of the armature 109 by welding. Due to the buffer spring 120 and the spring holder 118, an assembling structure of the injector 101 according to the related art is complicated, and the number of components required for the injector 101 according to the related art increases. Thus, manufacturing efficiency or economic feasibility of the injector 101 according to the related art is lowered.

SUMMARY OF THE INVENTION

The present invention provides a direct spray fuel injector having an improved structure in which the structure of a bundle of opening/closing valves for suppressing bounce of a valve needle generated when a valve is opened due to collision between members for closing a spray hole or an injection pressure of a fuel injected under a high pressure, is simplified so that manufacturing cost or the number of assembling processes of the direct spray fuel injector can be reduced and workability is improved so that manufacturing efficiency or economic feasibility of the bundle of opening/closing valves, further, the direct spray fuel injector can be improved.

According to an aspect of the present invention, there is provided a direct spray fuel injector including a bundle of opening/closing valves, wherein the bundle of opening/closing valves includes: a valve needle that is disposed within a valve housing that constitutes an exterior of the direct spray fuel injector in a lengthwise direction and that opens and closes a spray hole opened to one side of the valve housing; an electromagnetic coil that is installed at a side opposite to the spray hole of the valve needle and causes a spray hole opening/closing operation of the valve needle to be performed; an armature that is coaxially mounted on an outer circumferential surface of the valve needle to be slidable in an axial direction so as to be positioned between the valve needle and the electromagnetic coil; and a pressurizing spring that is installed to pressurize the valve needle toward the spray hole and causes the valve needle to close the spray hole in normal times, and wherein the bundle of opening/closing valves is configured to pressurize the valve needle by the armature so that bounce generated when the valve needle in an open state approaches the spray hole so as to close the spray hole is able to be attenuated.

The armature may be configured to secure a buffer gap between the armature and a stop ring fixed to one side of the valve needle or a stop sleeve fixed to the other side opposite to the stop ring of the valve needle, and the armature may be pressurized toward the stop sleeve by a buffer spring between the stop ring and the stop sleeve.

A spring seat may be formed on a circumference of the valve needle of a surface facing the stop ring, and the armature may be pressurized toward the stop sleeve by the buffer spring mounted on the spring seat.

A plurality of attenuation holes may pass through the stop sleeve on a support plate contacting the armature so that a shock generated when the armature contacts the support plate is able to be alleviated.

The plurality of attenuation holes may each have a tapered nozzle shape in which each of diameters of the attenuation holes decrease as getting closer to an opposite side to the armature.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, a direct spray fuel injector according to an embodiment of the present invention will be described more fully with reference to the accompanying drawings, in which the exemplary embodiment of the invention is shown.

Figure 1:
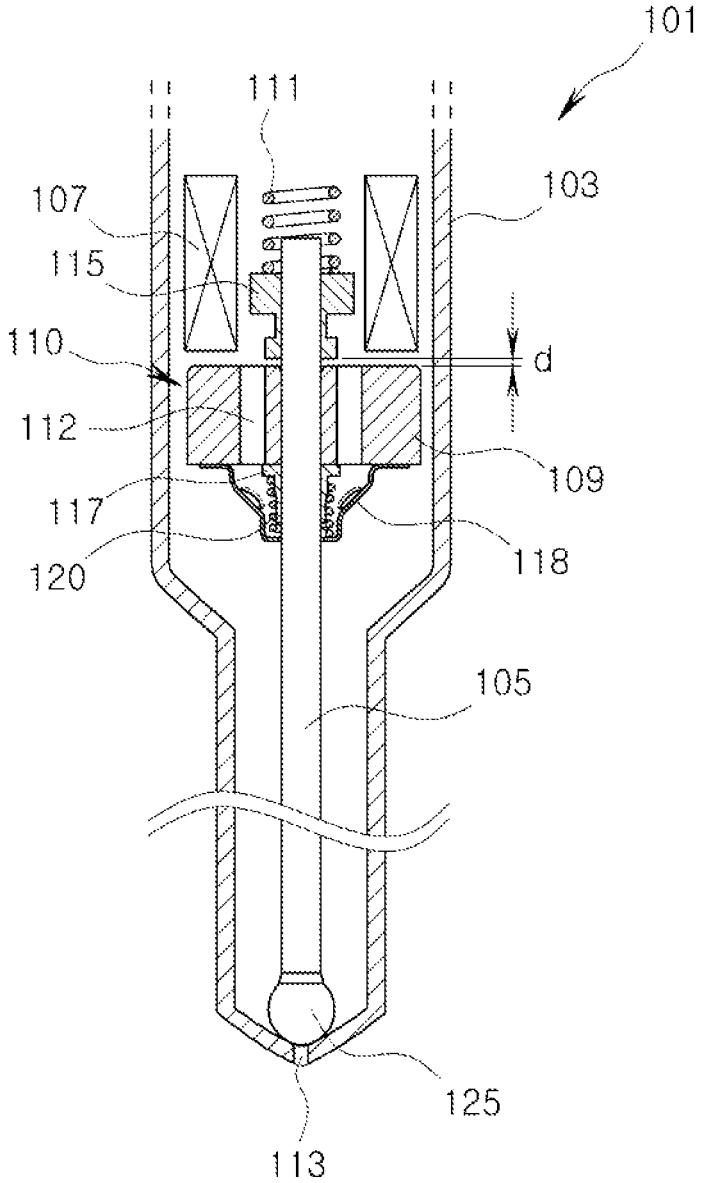
FIG. 1 is a partial enlarged cross-sectional view of a direct spray fuel injector according to the related art.
Figure 2:
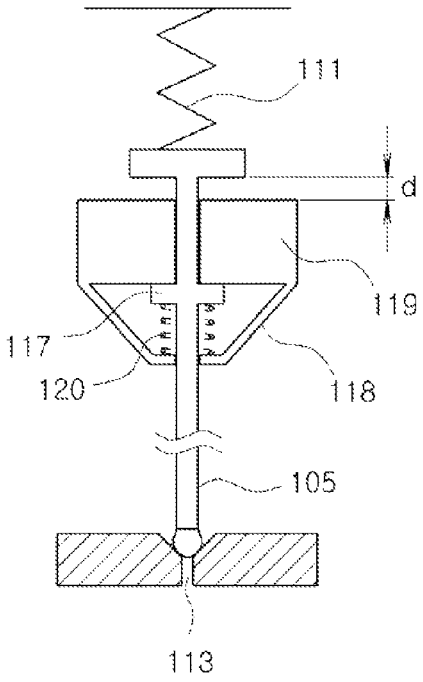
FIG. 2 is a mimetic diagram illustrating a valve closure state of the direct spray fuel injector illustrated in FIG. 1.
Figure 3:
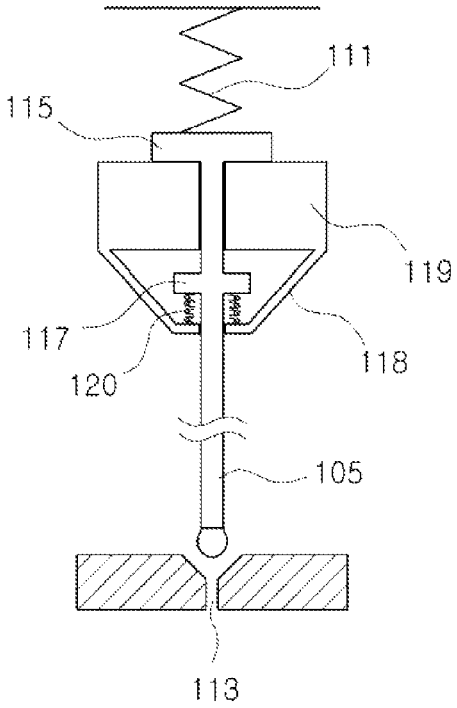
FIG. 3 is a mimetic diagram illustrating a valve opening state of the direct spray fuel injector of FIG. 1.
Figure 4:
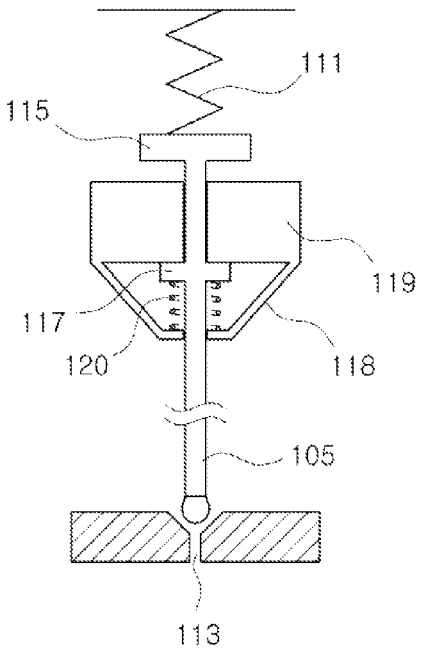
FIG. 4 is a mimetic diagram illustrating a bounce prevention operation of the direct spray fuel injector of FIG. 1.
Figure 5:
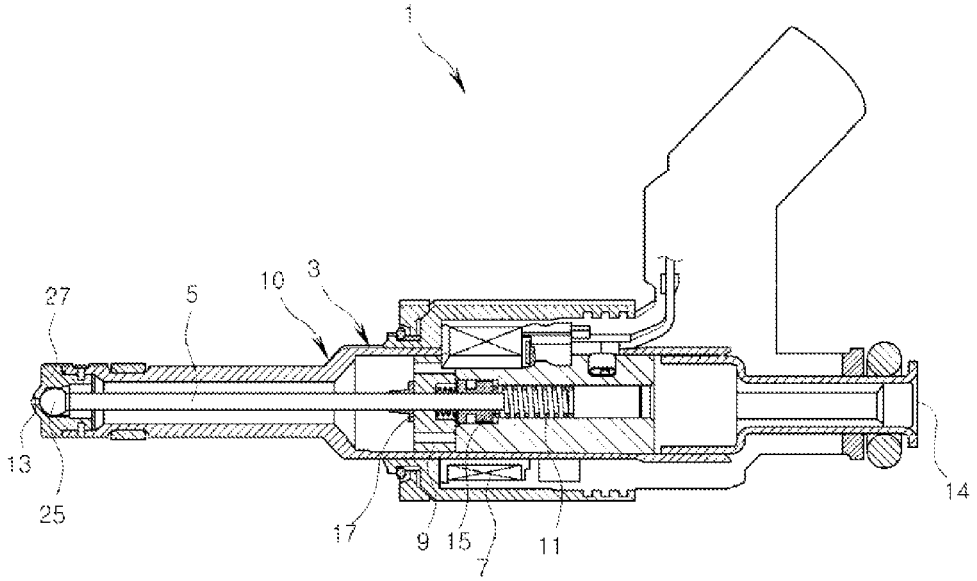
FIG. 5 is a longitudinal cross-sectional view illustrating a direct spray fuel injector according to an embodiment of the present invention.
Figure 6:
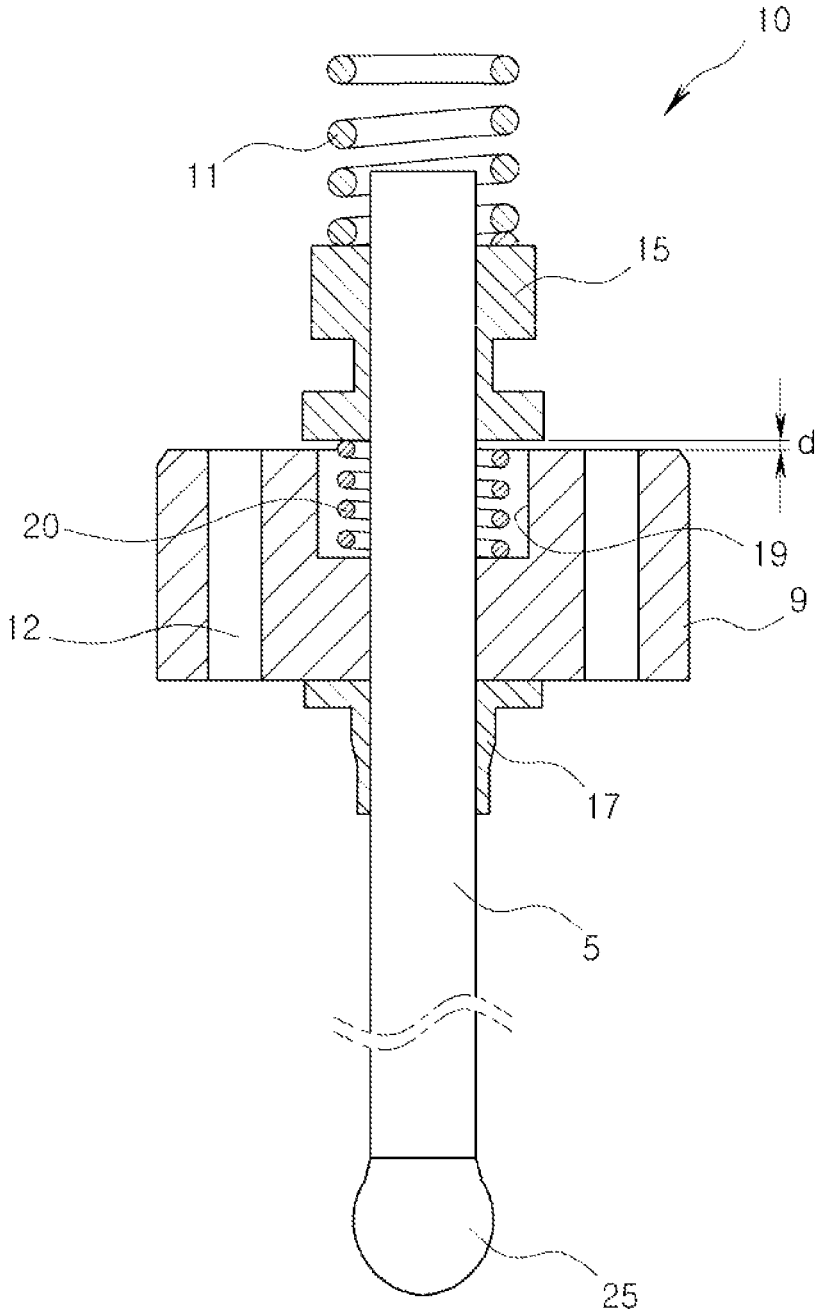
FIG. 6 is a longitudinal cross-sectional view illustrating a bundle of opening/closing valves of the direct spray fuel injector illustrated in FIG. 5 in detail.

A direct spray fuel injector according to the current embodiment of the present invention, as marked by reference numeral 1 in FIG. 5, includes a bundle of opening/closing valves 10 as illustrated in FIGS. 5 and 6 so as to inject a fuel that flows in the direct spray fuel injector 1 through a fuel inlet 14, through a spray hole 13 under a high pressure. Thus, the bundle of opening/closing valves 10 includes a valve needle 5, an electromagnetic coil 7, an armature 9, and a pressurizing spring 11, as illustrated in FIGS. 5 and 6.

First, the valve needle 5 directly opens or closes the spray hole 13 inside the direct spray fuel injector 1. The valve needle 5 extends into a valve housing 3 that constitutes the exterior of the direct spray fuel injector 1 in a lengthwise direction, as illustrated in FIGS. 5 and 6. Thus, a valve ball 25 is formed at a front end of the valve needle 5 that is adjacent to the spray hole 13, is mounted on a valve seat 27, and the pressurizing spring 11 is inserted into a rear end of the direct spray fuel injector 1 that is adjacent to the fuel inlet 14. Thus, the valve needle 5 makes a reciprocating motion right and left of FIG. 5 along an axial line of the valve housing 3 and opens or closes the spray hole 13.

The electromagnetic coil 7 is a driving unit that cause the valve needle 5 forward/backward while being repeatedly excited and demagnetized according to a fuel supply state. Since the electromagnetic coil 7 surrounds the armature 9 fixed to a circumferential surface facing the spray hole 13 of the valve needle 5, as illustrated in FIG. 5, the armature 9 is pulled when the electromagnetic coil 7 is excited, and the valve needle 5 is retreated to open the spray hole 13. In contrast, the valve needle 5 is returned to its original position due to an elastic force of the pressurizing spring 11 when the electromagnetic coil 7 is demagnetized to close the spray hole 13.

The armature 9 is a unit for transferring a magnetic force of the electromagnetic coil 7 to the valve needle 5. The armature 9 is formed of a cylindrical metal material, and a fuel passage 12 passes through the armature 9 in an axial direction so that a fuel flow in the valve housing 3 is not disturbed, as illustrated in FIGS. 5 and 6. Also, the armature 9 is mounted on a surface facing the spray hole 13 of the valve needle 5, i.e., is coaxially mounted on the valve needle 5 so that the armature 9 is positioned between the valve needle 5 and the electromagnetic coil 7 at the rear of FIG. 5 or at an upper side of FIG. 6. Thus, when the armature 9 is pulled by the excited electromagnetic coil 7 or when the armature 9 is pressurized by a buffer spring 20, the armature 9 is movable in an axial direction along an outer circumferential surface of the valve needle 5 between a stop ring 15 and a stop sleeve 17.

Last, the pressurizing spring 11 is a unit for pressurizing the valve needle 5 toward the spray hole 13. The pressurizing spring 11 is configured to pressurize the valve needle 5 that opens and closes the spray hole 13 toward the spray hole 13 in normal times, i.e., when no injection operation is performed, so as to cause the valve needle 5 to close the spray hole 13. To this end, one end of the pressurizing spring 11 is supported on an inner circumferential surface of the valve housing 3, and the pressurizing spring 11 pressurizes the valve needle 5 toward the spray hole 13 via the stop ring 15 that contacts the other end of the pressurizing spring 11.

Figure 9:
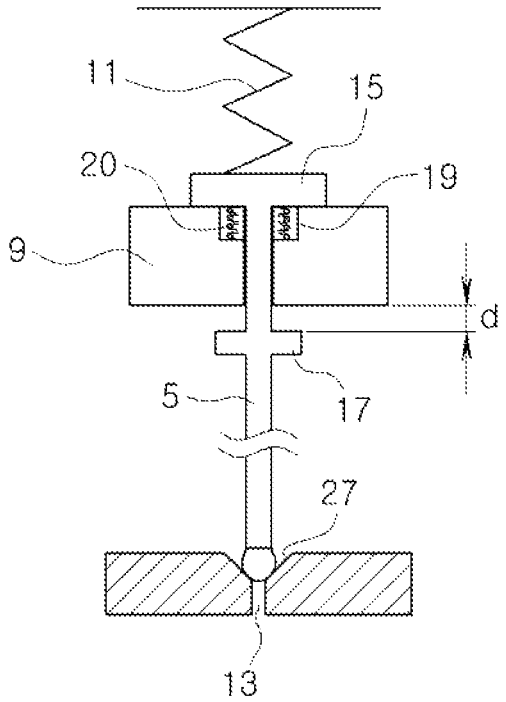
FIG. 9 is a mimetic diagram illustrating a state in which an armature is lifted by an electromagnetic coil in FIG. 8.
Figure 10:
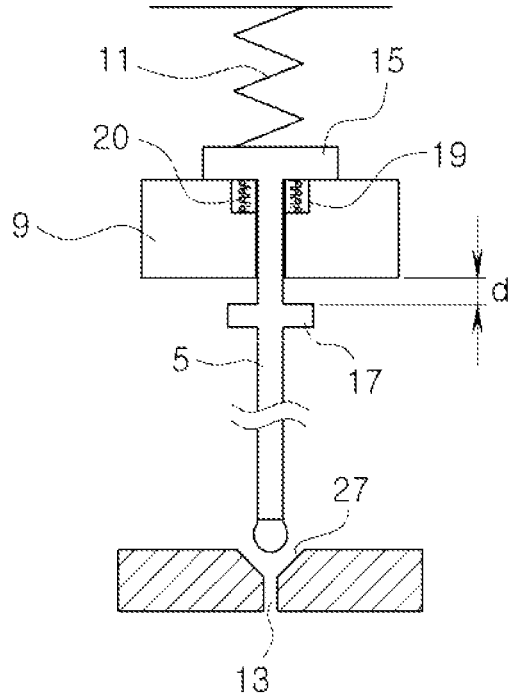
FIG. 10 is a mimetic diagram illustrating a state in which a valve needle is lifted by the armature and a spray hole is opened in FIG. 9.
Figure 11:
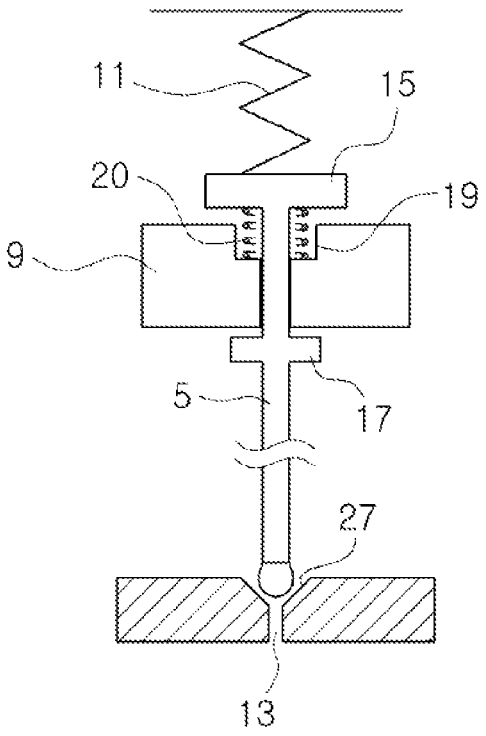
FIG. 11 is a mimetic diagram illustrating a state in which the valve needle is lifted by bounce in FIG. 9.

However, when the armature 9 pressurizes the valve needle 5 via the stop sleeve 17 and causes the valve needle 5 to approach the spray hole 13 so that a valve opening state illustrated in FIG. 10 is changed into a valve closure state of FIG. 9. The armature 9 is reversely bounced due to an elastic repulsive force generated during a collision between members involved in closure of the spray hole 13 or due to an injection pressure of the fuel injected through the spray hole 13, as illustrated in FIG. 11. Thus, the bundle of opening/closing valves 10 according to the present invention is configured to attenuate and suppress the bounce of the valve needle 5 through the armature 9.

Figure 8:
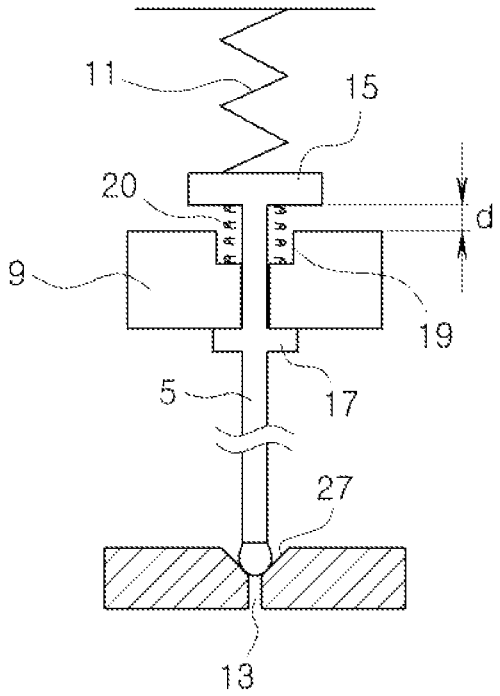
FIG. 8 is a mimetic diagram illustrating a closure state of the direct spray fuel injector of FIG. 7.

To this end, the armature 9 is mounted to be slidable along the valve needle 5 between the stop ring 15 fixed to one side, i.e., the upper side of the valve needle 5 and the stop sleeve 17 fixed to the other side opposite to the stop ring 15 of the valve needle 5, i.e., the lower side of the valve needle 5. In this case, a distance between the stop ring 15 and the stop sleeve 17 is larger than a thickness of the armature 9, for example, by about 40 μm, so as to secure a buffer gap d, as illustrated in FIGS. 6 and 8 through 12. Also, the armature 9 is always pressurized toward the stop sleeve 17 due to the buffer spring 20 inserted into a circumference of the valve needle 5 between the stop ring 15 and the stop sleeve 17. Thus, as illustrated in FIGS. 5 and 6, a spring seat 18 on which the buffer spring 20 may be mounted may be formed on the circumference of the valve needle 5 of a surface facing the stop ring 15. Thus, the valve needle 5 pressurizes the buffer spring 20 inserted into the spring seat 19 via the stop ring 15 and causes the armature 9 to always closely contact the stop sleeve 17. As a result, the buffer gap d between the stop ring 15 and the armature 9 is maintained in normal times, as illustrated in FIGS. 6 and 8.

Figure 7:
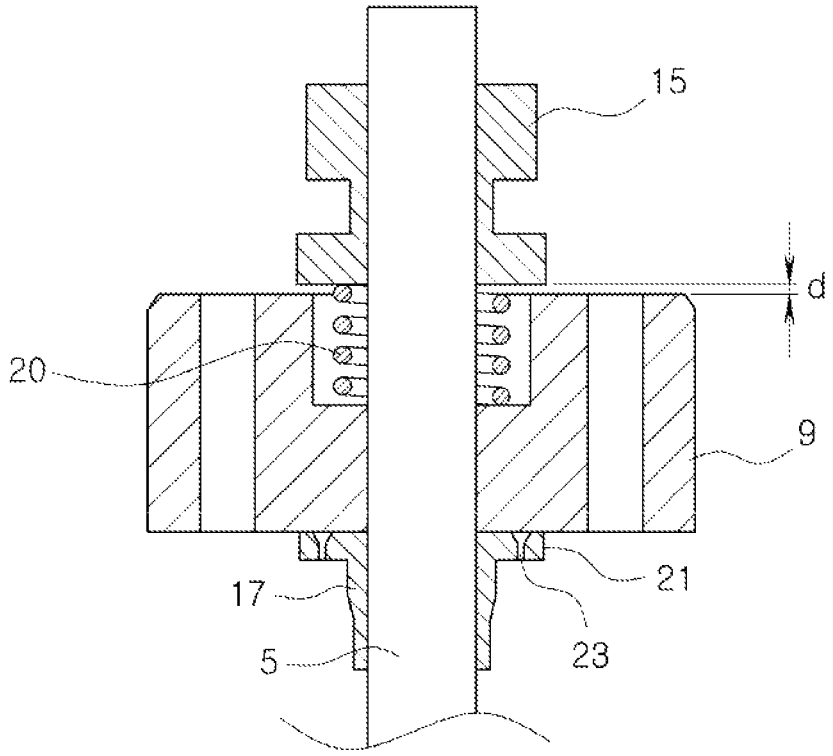
FIG. 7 is a longitudinal cross-sectional view illustrating a direct spray fuel injector according to another embodiment of the present invention.

According to another embodiment of the present invention, a plurality of attenuation holes 23 may pass through the stop sleeve 17 of the bundle of opening/closing valves 10 on a latitudinal support plate 21 that contacts the armature 9, as illustrated in FIG. 7. When the armature 9 that compresses the buffer spring 20 when the electromagnetic coil 7 is excited contacts the stop sleeve 17 due to a repulsive force of the buffer spring 20 when the electromagnetic coil 7 is demagnetized, the fuel between the support plate 21 and the armature 9 is extruded through the plurality of attenuation holes 23 such that a shock between the armature 9 and the stop sleeve 17 can be alleviated. In this case, the attenuation holes 23 may be manufactured in one of various cross-sectional shapes, like a tapered nozzle shape in which each of diameters of the attenuation holes 23 decreases as getting closer to an opposite site to the armature 9. For example, the attenuation holes 23 each may have a shape of a funnel that widens toward the armature 9, as illustrated in FIG. 7.

An operation of the direct spray fuel injector 1 having the above configuration according to the present invention will now be described.

The direct spray fuel injector 1 according to the present invention performs an opening/closing operation of a valve using the bundle of opening/closing valves 10 illustrated in FIGS. 5 and 6. Thus, the valve opening/closing operation will now be described with reference to FIGS. 8 through 12. In this case, for easy understanding of the valve opening/closing operation, FIGS. 8 through 12 illustrate the case that the buffer gap d is exaggerated and the stop ring 15 or the stop sleeve 17 fixed to the direct spray fuel injector 1 due to welding of the valve needle 5 is formed integrally with the valve needle 5.

As illustrated in FIGS. 5 and 6 or 8, in the bundle 10 of opening/closing valves, in normal times when fuel injection is not performed, the stop ring 15 is pressurized by an elastic force of the pressurizing spring 11, and the valve needle 5 formed integrally with the stop ring 15 closely contacts the valve seat 27 to close the spray hole 13. In this case, the buffer spring 20 causes the armature 9 to closely contact the stop sleeve 17 due to the stop ring 15 so that the buffer gap d between the armature 9 and the stop ring 15 can be secured.

In this state, if the electromagnetic coil 7 is excited for fuel injection, the armature 9 is pulled in an upward direction of FIGS. 6 and 8 due to a magnetic force of the electromagnetic coil 7. Thus, the armature 9 first compresses the buffer spring 20 having a smaller elastic coefficient than that of the pressurizing spring 11 and is lifted in an upward direction of FIG. 9 until the buffer spring 20 is caught in the stop ring 15.

In this way, if the armature 9 caught in the stop ring 15 is continuously pulled by the electromagnetic coil 7, the armature 9 compresses the pressurizing spring 11 via the stop ring 15 and moves in an upward direction of the drawing, as illustrated in FIG. 10. Thus, the valve needle 5 is spaced apart from the valve seat 27 so that the spray hole 13 can be opened and the fuel in the direct spray fuel injector 1 can be injected through the spray hole 13 under a high pressure.

Subsequently, if the electromagnetic coil 7 is demagnetized so as to stop fuel injection, gravity that exerts on the armature 9 disappears from the electromagnetic coil 7. As a result, the pressurizing spring 11 having a relatively large elastic coefficient is first returned to its original state, and the valve needle 5 is pushed in a downward direction of the drawing and closes the spray hole 13, as illustrated in FIG. 11.

However, due to the elastic repulsive force generated when members collide with each other or the injection pressure of the high-pressure fuel, the valve needle 5 is bounced in an upward direction of the drawing, as illustrated in FIG. 11. Thus, the valve needle 5 compresses the pressurizing spring 11 again and is lifted upwardly. However, the armature 9 is pressurized by a restorative force of the buffer spring 20 and still descends in a downward direction of the drawing.

Figure 12:
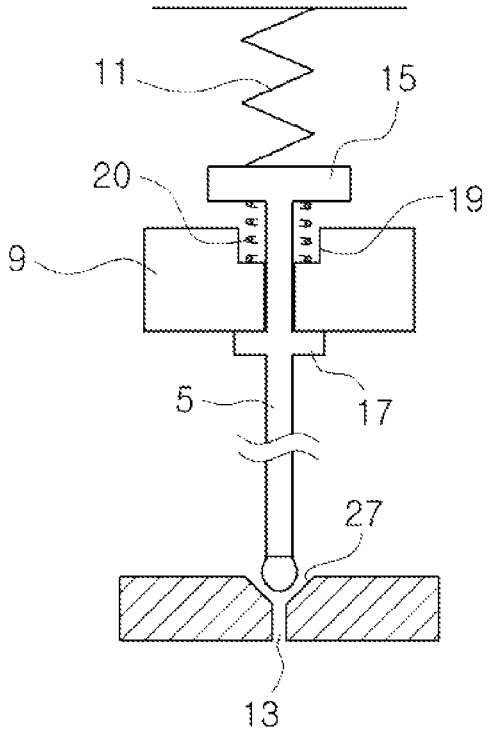
FIG. 12 is a mimetic diagram illustrating a state in which the valve needle lifted by bounce is pressurized by the armature and bounce is suppressed in FIG. 11.

Thus, as illustrated in FIG. 12, the valve needle 5 that is lifted in an upward direction of the drawing contacts the armature 9 in which the stop sleeve 17 moving together with the valve needle 5 descends downwardly and the valve needle 5 is pressurized downward so that further bounce can be suppressed, the spray hole 13 is closed and a valve closure state is constituted.

When the attenuation holes 23 pass through the support plate 21 of the stop sleeve 17, as in another embodiment of the present invention, if the descending armature 9 contacts the stop sleeve 17, the fuel that exists between the stop sleeve 17 and the armature 9 is compressed through the attenuation holes 23 so that a descending force of the armature 9 can be attenuated and a shock applied to the stop sleeve 17 can be alleviated.

Accordingly, in a direct spray fuel injector according to the present invention, in particular, when a spray hole is closed by a valve needle so as to stop fuel injection, bounce generated due to an elastic repulsive force when a valve ball at a front end of the valve needle and a valve seat around the spray hole contact each other or due to a high fuel injection pressure is suppressed and prevented by an armature so that the structure of a buffer spring required to suppress the bounce of the valve needle is simplified, the number of components for a bundle of opening/closing valves is reduced, an assembling process is simplified and manufacturing cost or the number of assembling processes of the bundle of opening/closing valves or the entire direct spray fuel injector can be reduced.

Furthermore, in order to suppress the bounce of the valve needle, a shock that is generated when the armature contacts a stop sleeve can be alleviated by an attenuation holes so that an operating noise caused by a collision noise can be reduced and further, durability and available life span of the bundle of opening/closing valves can be increased.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A fuel injector for directly injecting fuel into a combustion chamber of an engine, comprising:

a valve needle that is disposed within a valve housing that constitutes an exterior of the fuel injector in a lengthwise direction and that opens and closes a spray hole opened to one side of the valve housing;

an electromagnetic coil that is installed at a side opposite to the spray hole and causes a spray hole opening/closing operation of the valve needle to be performed;

an armature that is coaxially mounted on an outer circumferential surface of the valve needle to be slidable along the outer circumferential surface of the valve needle in an axial direction so as to be positioned between the valve needle and the electromagnetic coil;

a pressurizing spring that is installed to pressurize the valve needle toward the spray hole and causes the valve needle to close the spray hole in normal times;

a stop ring that is fixed to an upper side of the valve needle and pressurized by the pressurizing spring; and a stop sleeve that is fixed to a lower side of the valve needle;

wherein the armature is slidably movable along the valve needle between the stop ring and the stop sleeve;

wherein the armature is pressurized toward the stop sleeve by a buffer spring so that when the spray hole is closed by the valve needle, a buffer gap is formed between the armature and the stop ring, and the armature is in direct contact with the stop sleeve; and wherein the buffer spring has a smaller elastic coefficient than the pressurizing spring and is configured to attenuate and suppress a bounce of the valve needle.

2. The fuel injector of claim 1, wherein a spring seat is formed on the surface of the armature facing the stop ring, and the armature is pressurized toward the stop sleeve by the buffer spring mounted on the spring seat.

3. The fuel injector of claim 1, wherein a plurality of attenuation holes pass through the stop sleeve on a support plate contacting the armature so that a shock generated when the armature contacts the support plate is able to be alleviated.

4. The fuel injector of claim 3, wherein a plurality of attenuation holes each has a tapered nozzle shape in which each of diameters of the attenuation holes decreases as getting to an opposite side to the armature.

5. The direct spray fuel injector of claim 2, wherein a plurality of attenuation holes pass through the stop sleeve on a support plate contacting the armature so that a shock generated when the armature contacts the support plate is able to be alleviated.

6. The fuel injector of claim 5, wherein the plurality of attenuation holes each have a tapered nozzle shape in which each of diameters of the attenuation holes decreases as getting closer to an opposite side to the armature.

* * * * *